United States Patent [19]

Somogyi

[11] 4,344,644

[45] Aug. 17, 1982

[54] DOMESTIC INVENTORY SYSTEM

[76] Inventor: Paul S. Somogyi, 60 Delwood Rd., Cherry Hill, N.J. 08002

[21] Appl. No.: 159,210

[22] Filed: Jun. 13, 1980

[51] Int. Cl.[3] ..... G09F 3/00; B42D 15/00

[52] U.S. Cl. ..... 283/19; 283/55

[58] Field of Search ..... 40/5, 390, 594, 585, 40/488, 489, 490; 116/321, 322, 323, 324, 325; 235/123; 283/55, 60 R, 19, 37, 48 R, 65, 1 A, 66 R; 220/270; 206/813, 628

[56] References Cited

U.S. PATENT DOCUMENTS

| | | | |
|---|---|---|---|
| 2,230,482 | 2/1941 | Butler | 116/324 |
| 2,497,285 | 2/1950 | Allardice | 40/488 |
| 3,891,117 | 6/1975 | Dragomier | 220/270 |
| 3,913,249 | 10/1975 | Kaslow | 116/323 X |
| 4,026,050 | 5/1977 | Boles | 116/323 X |
| 4,159,129 | 6/1979 | Lockhart | 283/66 R X |

*Primary Examiner*—Paul A. Bell
*Assistant Examiner*—John S. Brown
*Attorney, Agent, or Firm*—Robert K. Youtie

[57] ABSTRACT

An inventory system including a display panel marked with a series of words for items to be inventoried, the panel markings having a certain characteristic appearance, such as being the same color, a plurality of checks or markers removably secured to the display member covering respective indicia or markings and having additional indicia or markings of the same connotation as the covered indicia, respectively, the additional indicia or markings having another characteristic appearance the same as each other but different from that of the first mentioned indicia.

7 Claims, 5 Drawing Figures

DOMESTIC INVENTORY SYSTEM

BACKGROUND OF THE INVENTION

As is well known to those versed in domestic science, management of inventory, such as food stuffs, presents considerable difficulties, often resulting in spoilage and waste of food. While there have, in the past, been proposed a number of indicators, and the like, for management of domestic inventory, such devices have not been entirely satisfactory and have not found wide acceptance and use. Examples of the prior art of which applicant is aware are the following U.S. Pat. Nos:

1,300,339;
1,462,390;
1,523,374;
1,717,048;
1,830,030;
1,830,031;
2,914,873;
3,505,973;
3,538,631;
3,949,935.

However, prior devices have been relatively complex and expensive in construction, often subject to damage and malfunction, difficult and time consuming to use, and otherwise unsatisfactory.

SUMMARY OF THE INVENTION

Accordingly, it is an important object of the present invention to provide an inventory system for domestic use which overcomes the above mentioned difficulties, is extremely simple in construction and operation, economical to produce, and entirely reliable in operation throughout a long useful life.

It is more particular object of the present invention to provide an inventory system of a type described, particularly adapted for the homemaker in managing the inventory of food items, both fresh and leftover, that may be stored in containers, as in the refrigerator, freezer, and the like. The inventory system of the present invention not only presents to view an immediately apparent list of items in the inventory, but also further serves to readily identify the contents of various containers, to assure full knowledge of all available foods and greatly simplify location of any selected food item.

In addition to the great convenience afforded by the instant inventory system, as in daily preparation of meals, the system serves to eliminate or minimize the spoilage of foods overlooked or forgotten.

Other objects of the present invention will become apparent upon reading the following specification and referring to the accompanying drawings, which form a material part of this disclosure.

The invention accordingly consists in the features of construction, combination of elements, and arrangements of parts, which will be exemplified in the construction hereinafter described, and of which the scope will be indicated by the appended claims.

DESCRIPTION OF THE PREFERRED EMBODIMENT

Figure 1:
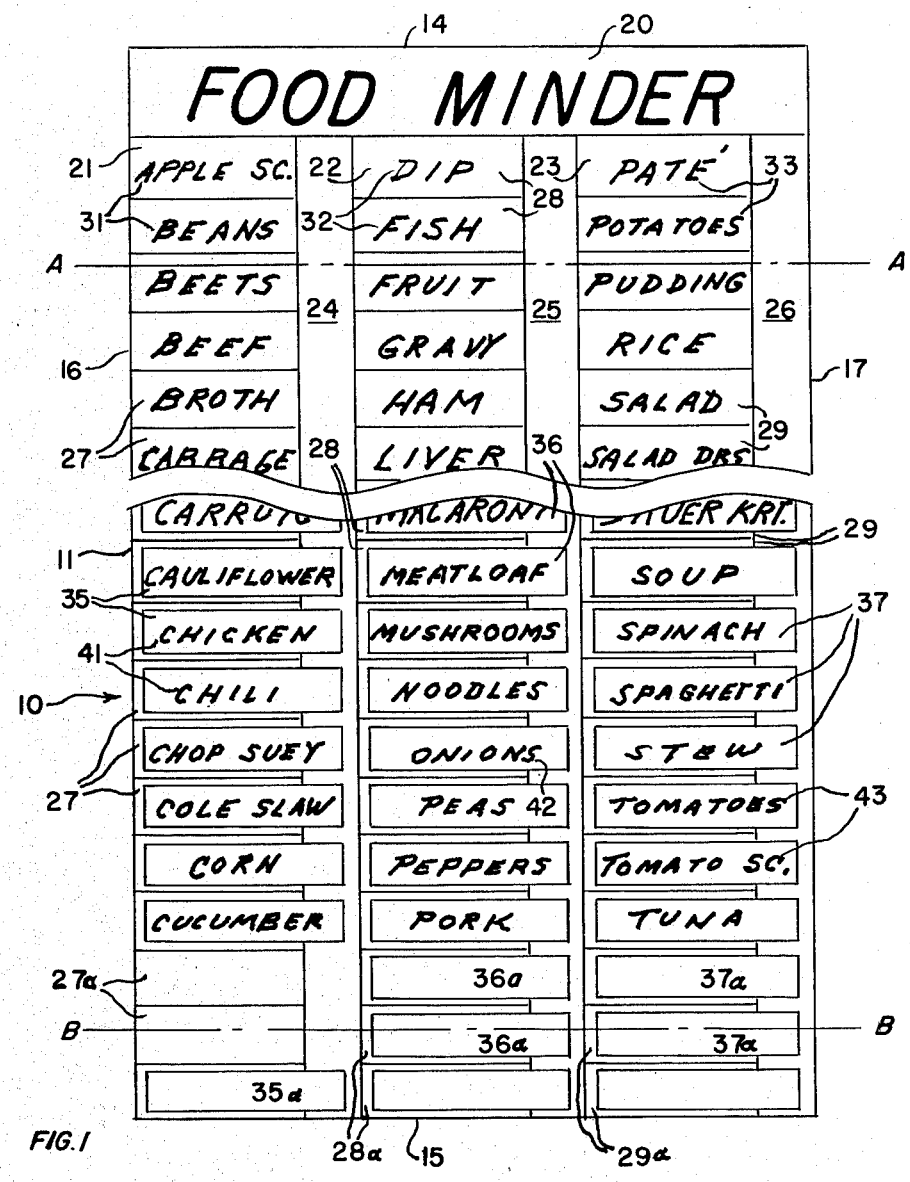
FIG. 1 is a front elevational view showing a domestic inventory system of the present invention, partly broken away to conserve drawing space and illustrating in the lower region the presence of markers absent from the upper region.
Figure 2:
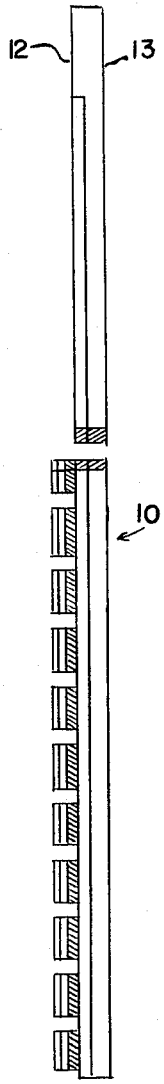
FIG. 2 is a side elevational view, as taken from the right-hand side of FIG. 1.

Referring now more particularly to the drawings, and specifically to FIGS. 1 and 2 thereof, the domestic inventory system of the present invention is generally designated 10, and includes a generally rectangular display member, board or panel 11 normally disposed in vertical or upright position, as by hanging on a wall, or standing on a supporting surface. The display member or panel 11 may be generally flat or planar, having a front surface 12, and a rear or back surface 13. Extending between the front and rear surfaces 12 and 13 are generally parallel, horizontal upper and lower edges 14 and 15, and the generally vertical parallel side edges 16 and 17. Across the upper region of front side 12, may be a title surface portion 20, generally flat and carrying suitable nomenclature as the title "FLOOD MINDER".

Figure 3:
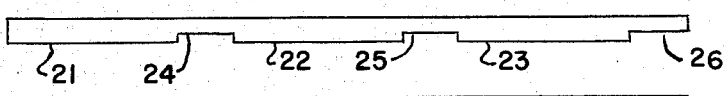
FIG. 3 is a generally horizontal sectional view taken along the line A—A in FIG. 1.
Figure 4:
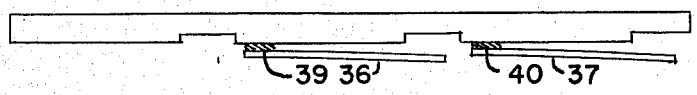
FIG. 4 is a horizontal sectional view taken along the line B—B in FIG. 1.
Figure 5:
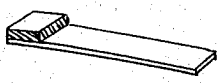
FIG. 5 is a perspective view showing a marker of the present invention apart from the display panel.

In addition, the front side 12 of panel 11 may be provided with one or more, outer, generally flat surface portions, such as the generally vertically disposed flat surface portions 21, 22 and 23. As best seen in FIGS. 1 and 3, the flat or outer surface portions 21, 22 and 23 may all be generally coplanar, extending vertically in generally parallel spaced relation with respect to each other, and arranged in laterally spaced relation across the front side 12 of panel 11. In addition, the front side 12 of panel 11 is formed with a plurality of generally vertically extending, parallel spaced inner or recess surface portions 24, 25 and 26, which are specifically located in alternate, interposed relation with respect to the outer flat surface portions 21, 22 and 23.

More particularly, along the vertical right-hand side of each flat surface portion 21, 22 and 23 is located a respective recessed surface portion 24, 25 and 26.

The flat or outer surface portions 21, 22 and 23 are each subdivided into a plurality of spaces arranged in a vertical series or row. For example, the flat surface portion 21 is marked for subdivision into a vertically arranged series or row of spaces 27, while the flat surface portion 22 is subdivided or marked to define a vertical series or row of spaces 28, and the flat surface portion 23 is marked for subdivision into vertical series or row of spaces 29.

As seen in the upper region of FIG. 1, the spaces 27, 28 and 29 are all marked with indicia or words designating items to be inventoried.

Thus, the indicia or markings 31 of flat surface portion 21 may include the words "applesauce", "beans", etc.; while the indicia or markings 32 of the flat surface portion 22 may include the words "dip", "fish", etc.; and the surface portion 23 may include the indicia or markings 33 including the words "paté", "potatoes", and others.

All of the indicia or markings 31, 32 and 33 on the flat surface portions 21, 22 and 23 have a certain characteristic appearance, so that the indicia on the flat surface portions may be quickly and easily identified. Such a characteristic appearance may be the same color, if desired, or other suitable characteristic appearance.

Certain of the spaces 27, 28 and 29 may be without any indicia or markings, say the lower three laterally extending rows of spaces 27*a*, 28*a* and 29*a*, for purposes appearing presently.

The spaces 27, 28 and 29 located below the break in FIG. 1, are shown as each provided with an overlaying marker, token or check. That is, overlaying the spaces 27 are tokens, checks or markers 35, respectively, while markers, tokens or checks 36 respectively overlay spaces 28, and additional markers, tokens or checks 37 respectively overlay spaces 29. The tokens or markers 35, 36 and 37 may each be fabricated of a stiff flexible material, such as plastic, being elongate in configuration corresponding to the size and shape of the spaces 27, 28 and 29 and their adjacent recessed portions.

In particular, each marker 35, 36 and 37 is sized and shaped to overlie a respective space 27, 28 and 29 and extend beyond the respective space to overlie the adjacent recessed potion 24, 25 and 26. The markers 35, 36 and 37 are each provided, on their under or inner sides, adjacent to one end with a securement pad, as at 38, 39 and 40, respectively. The pads 38, 39 and 40 are each detachably securable to the flat surface portions 21, 22 and 23, as by pressure sensitive adhesive, or other suitable means. As the securement pads 38, 39 and 40 are located on the leftward ends of the respective markers 35, 36 and 37, it will be appreciated that the remainder of the markers are spaced from the display panel 11. Further, the rightward end regions of the markers 35, 36 and 37 overlie the recessed surface portions 24, 25 and 26, respectively, of the panel 11, so as to be considerably spaced therefrom. By this means, the recessed surface portions 24, 25 and 26 define finger receivers permitting of convenient manual grasping of the markers for removal and replacement with respect to the panel.

The several markers 35, 36 and 37 are provided on their forward or outer surfaces with indicia 41, 42 and 43, respectively. corresponding to the indicia 31, 32 and 33 of the underlying spaces 27, 28 and 29. That is, the printed word indicia 41 "CHICKEN", and "CHILI" of the markers 35 respectively overlie spaces 27 marked with the same printed indicia. Similarly, the indicia 42 "ONIONS" overlies the indicia 32 "ONIONS" of the underlying space 28, and the word indicia "SPINACH" overlies the same word indicia on the underlying space 29. Further, the indicia 41, 42 and 43 provided on the markers 35, 36 and 37 is all of the same characteristic appearance, which is different from the characteristic appearance of the indicia 31, 32 and 33. For example, the marker indicia 41, 42 and 43 may be the same color, which color is different from that of the panel indicia 31, 32 and 33. Thus, with certain markers 35, 36 and 37 absent or removed from the panel 11, their absence is quickly and easily apparent by the visual presentation of the indicia 31, 32 and 33 of a color different from that of the marker indicia 41, 42 and 43.

Removably secured in covering relation with the unmarked spaces 27*a*, 28*a* and 29*a* may be markers, tokens or checks 35*a*, 36*a* and 37*a*, which may be identical to the markers 35, 36 and 37, but are without indicia. However, the forward or front surfaces of the markers 35*a*, 36*a* and 37*a* are capable of being marked, as by having suitable roughness or otherwise capable of being marked. Further, the spaces 27*a*, 28*a* and 29*a*, which have been described as without indicia, are also capable of being marked. Hence, the spaces 27*a*, 28*a* and 29*a*, together with the markers 35*a*, 36*a* and 37*a* may be marked with any suitable inidicia, as desired by the user, say to indicate an item not appearing elsewhere, or possibly to indicate the presence of plural containers of a single item.

In use, when the homemaker, cook or other intends to store food in the refrigerator or elsewhere, the person need only insert a fingernail behind the right-hand end of the desired marker and remove the same by manual grasping and pulling away from the stored position on the panel. This removed marker may by pressure be attached to the lid or elsewhere on the storage container, which may then be placed in the refrigerator. The differently colored indicia exposed upon removal of the marker indiciates the existence of this item in inventory, while the marker attached to the container permits of quick location of the item from among many containers.

From the foregoing, it is seen that the present invention provides an inventory system which is extremely simple in structure, capable of quick and easy operation, to effectively prevent the spoilage of food stuffs, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A domestic inventory system comprising a board-like display member for mounting on a wall, a vertically aligned series of indicia on said member representing a variety of items of household use, said series of indicia being of a color having a characteristic appearance, and a plurality of markers each corresponding to a respective one of said indicia and removably and replaceably secured to said member in covering relation with the corresponding indicia, said markers being of a color having a second characteristic appearance different from the first mentioned characteristic appearance, and said markers being removably securable to refrigerator food containers for designating the contents thereof upon removal from said member, to thereby present to view said indicia having said first mentioned characteristic appearance as exposed upon marker removal to indicate the current inventory of items of household use.

2. A domestic inventory system according to claim 1, said display member comprising a relatively thick panel, a generally flat surface portion on said panel carrying said indicia, and a recessedsurface portion on said panel extending along said flat surface portion, said markers being of stiff flexible material and each having one region removably securable to said flat surface portion and having another region extending spacedly over said recessed surface portion, said other regions of said markers being spaced from said recess to provide finger tabs for manipulation of said markers.

3. A domestic inventory system according to claim 2, said markers each being elongate and having one end portion defining said other region and extending spacedly over said recessed surface portion to define a finger tab.

4. A domestic inventory system according to claim 3, in combination with pressure sensitive adhesive carried by each marker spaced from said one end portion, for marker securement to said flat surface portion and freedom of said tab from said recessed surface portion.

5. A domestic inventory system according to claim 2, in combination with additional flat surface portions on said panel extending in parallel spaced relation with each other and said first mentioned flat surface portion, and additional recessed surface portions on said panel interposed between said first mentioned and additional flat surface portions to define finger receivers for grasping said markers.

6. A domestic inventory system according to claim 5, said first mentioned and additional flat surface portions extending generally vertically, and said markers extending laterally from one of said first mentioned and additional flat surface portions to overly one of said first mentioned and additional recessed surface portions.

7. A domestic inventory system according to claim 2, in combination with an additional flat surface portion on said panel without indicia and adapted to receive indicia, an additional recessed surface portion on said panel along said additional flat surface portion, and an additional marker without indicia and adapted to receive indicia, said additional marker being removably secured to said additional flat surface portion extending over said additional recessed surface portion, said additional marker being selectively securable to a refrigerator food container and said additional marker and additional flat surface portion being adapted to receive indicia designating the contents of the respective refrigerator food container.

* * * * *